US006180181B1

(12) United States Patent
Verardi et al.

(10) Patent No.: US 6,180,181 B1
(45) Date of Patent: Jan. 30, 2001

(54) METHODS FOR FORMING COMPOSITE COATINGS ON SUBSTRATES

(75) Inventors: Christopher A. Verardi; Dennis L. Faler; Marvis E. Hartman; Nicholas J. Crano, all of Pittsburgh; Rodger G. Temple, Sarver; Victoria A. Trettel, Freeport, all of PA (US)

(73) Assignee: PPG Industries Ohio, Inc., Cleveland, OH (US)

( * ) Notice: Under 35 U.S.C. 154(b), the term of this patent shall be extended for 0 days.

(21) Appl. No.: 09/211,127

(22) Filed: Dec. 14, 1998

(51) Int. Cl.[7] ..... B05D 1/36; B05D 7/16

(52) U.S. Cl. ..... 427/409; 427/410; 427/412.1; 427/412.3

(58) Field of Search ..... 427/407.1, 409, 427/410, 412.1, 412.3

(56) References Cited

U.S. PATENT DOCUMENTS

| | | | | |
|---|---|---|---|---|
| 3,563,957 | | 2/1971 | Beebe | 260/77.5 |
| 4,147,679 | | 4/1979 | Scriven et al. | 260/29.2 TN |
| 4,220,679 | | 9/1980 | Backhouse | 427/401 |
| 4,303,581 | | 12/1981 | Levine et al. | 260/18 PF |
| 4,375,498 | * | 3/1983 | Le Minez et al. | 428/416 |
| 4,390,658 | * | 6/1983 | Graetz et al. | 524/512 |
| 4,403,003 | | 9/1983 | Backhouse | 427/407.1 |
| 4,533,254 | | 8/1985 | Cook et al. | 366/176 |
| 4,563,372 | * | 1/1986 | Kurauchi et al. | 427/409 |
| 4,755,435 | | 7/1988 | Fujii et al. | 428/461 |
| 4,756,975 | | 7/1988 | Fujii et al. | 428/461 |
| 4,764,430 | | 8/1988 | Blackburn et al. | 428/413 |
| 4,933,056 | | 6/1990 | Corrigan et al. | 204/181.7 |
| 4,968,536 | | 11/1990 | Goldner et al. | 427/388.4 |
| 5,047,294 | | 9/1991 | Schwab et al. | 428/432.1 |
| 5,071,904 | | 12/1991 | Martin et al. | 524/458 |
| 5,098,947 | | 3/1992 | Metzger et al. | 524/507 |
| 5,126,393 | | 6/1992 | Blum et al. | 524/538 |
| 5,196,485 | | 3/1993 | McMonigal et al. | 525/327.3 |
| 5,204,404 | | 4/1993 | Werner et al. | 524/501 |
| 5,236,995 | * | 8/1993 | Salatin et al. | 427/402 |
| 5,262,464 | | 11/1993 | Koevenig et al. | 524/413 |
| 5,294,665 | | 3/1994 | Pedain et al. | 524/591 |
| 5,326,596 | | 7/1994 | Kasari et al. | 427/379 |
| 5,489,448 | | 2/1996 | Jackson et al. | 427/421 |
| 5,530,043 | | 6/1996 | Zawacky et al. | 524/317 |
| 5,548,016 | | 8/1996 | Provenzola | 524/507 |
| 5,569,715 | | 10/1996 | Grandhee | 525/7 |
| 5,589,228 | | 12/1996 | Wegner et al. | 427/407.1 |
| 5,597,861 | | 1/1997 | Nakae et al. | 524/601 |
| 5,658,617 | | 8/1997 | Gobel et al. | 427/372.2 |
| 5,663,240 | | 9/1997 | Simeone et al. | 525/327.3 |
| 5,674,560 | | 10/1997 | Tanigami et al. | 427/202 |
| 5,676,813 | | 10/1997 | Nakamura et al. | 205/50 |
| 5,691,002 | | 11/1997 | Oda et al. | 427/407.1 |
| 5,705,595 | | 1/1998 | Oda et al. | 528/71 |
| 5,725,908 | * | 3/1998 | Ogasawara et al. | 427/409 |
| 5,731,089 | | 3/1998 | Kunikiyo et al. | 428/423.1 |
| 5,759,695 | * | 6/1998 | Primeaux, II | 427/407.1 |
| 5,760,107 | | 6/1998 | Valko et al. | 523/404 |
| 5,760,128 | * | 6/1998 | Baltus et al. | 427/407.1 |
| 5,786,420 | | 7/1998 | Grandhee | 525/7 |
| 5,814,410 | | 9/1998 | Singer et al. | 428/423.1 |
| 5,820,987 | | 10/1998 | Kaufman et al. | 428/413 |
| 5,962,574 | * | 10/1999 | Jackson et al. | 524/495 |
| 6,001,469 | * | 12/1999 | Verardi et al. | 428/333 |
| 6,013,324 | * | 1/2000 | Frangou et al. | 427/388.4 |

FOREIGN PATENT DOCUMENTS

| | | |
|---|---|---|
| 2054550 | 5/1992 | (CA) . |
| 3440534 | 5/1986 | (DE) . |
| 4337961 | 5/1995 | (DE) . |
| 19529394 | 2/1996 | (DE) . |
| 4421172 | 5/1996 | (DE) . |
| 0 823 289 | 2/1998 | (EP) . |
| 6200186 | 7/1994 | (JP) . |
| 6220358 | 8/1994 | (JP) . |
| WO96/12769 | 3/1996 | (WO) . |

OTHER PUBLICATIONS

Hawley's Condensed Chemical dictionary, 12th Ed., 1993, p. 15.
Hawley's Condensed Chemical Dictionary, 12th Ed., 1993, p. 435.
Hawley's Condensed Chemical Dictionary, 12th Ed., 1993 p. 618.
Kirk–Othmer Encyclopedia of Chemical Technology, vol. 1, 1963, pp. 224–254.
Kirk–Othmer Encyclopedia of Chemical Technology, vol. 1, 1963, pp. 203–205, 259–297 and 305–307.
Kirk–Othmer Encyclopedia of Chemical Technology, vol. 1, 1963, p. 305.
*General Chemistry* by K. Whitten et al., 1981, p. 192.

* cited by examiner

*Primary Examiner*—Erma Cameron
(74) *Attorney, Agent, or Firm*—Ann Marie Cannoni

(57) ABSTRACT

The present invention provides methods for forming composite coatings on substrates including the steps of: (A) applying an aqueous primary coating composition to at least a portion of a surface of a substrate, the primary coating composition including: (1) at least one thermosettable dispersion including polymeric microparticles having functionality adapted to react with a crosslinking material, the microparticles including: (a) at least one acid functional reaction product of ethylenically unsaturated monomers; and (b) at least one hydrophobic polymer having a number average molecular weight of at least about 500; and (2) at least one crosslinking material, to form a substantially uncured primary coating thereon; (B) applying a secondary coating composition to at least a portion of the primary coating formed in step (A) without substantially curing the primary coating to form a substantially uncured secondary coating thereon; and (C) applying a clear coating composition to at least a portion of the secondary coating formed in step (B) without substantially curing the secondary coating to form a substantially uncured composite coating thereon.

40 Claims, No Drawings

METHODS FOR FORMING COMPOSITE COATINGS ON SUBSTRATES

FIELD OF THE INVENTION

The present invention relates to methods for forming coating films on metallic and polymeric substrates and, more particularly, to composite coatings including a primary layer, basecoat and clearcoat which are applied in a wet-on-wet-on-wet process which when cured provide good chip resistance and a smooth finish.

BACKGROUND OF THE INVENTION

Over the past decade, there has been a concerted effort to reduce atmospheric pollution caused by volatile solvents which are emitted during the painting process. However, it is often difficult to achieve high quality, smooth coating finishes, such as are required in the automotive industry, without using organic solvents, which contribute greatly to flow and leveling of a coating. In addition to achieving near-flawless appearance, automotive coatings must be durable and chip resistant, yet economical and easy to apply.

Currently, in the automotive industry the coating system which provides a good balance between economy, appearance and physical properties is a system having four individual coating layers. The first coating is a corrosion resistant primer which is applied by electrodeposition and cured. The next coating is a primer/surfacer which is spray applied and then cured. The third coating is a spray-applied colored basecoat. The basecoat is generally not cured before the application of the final coating, the clear coat which is designed to provide toughness and high gloss to the system. The process of applying one layer of a coating before the previous layer is cured is referred to as a wet-on-wet ("WOW") application.

U.S. Pat. No. 5,262,464 discloses a primer which can be dried at ambient conditions for 60 minutes and coated with a waterborne basecoat and two component, low VOC clearcoat (column 7, line 60 to column 8, line 44). The primer coating composition includes an aqueous dispersion of a thermoplastic anionic polyacrylate or polyurethane. The polyacrylate has functional carboxylic acid or anhydride groups which are neutralized with ammonia. The polyurethane is also neutralized with ammonia or an amine to be dispersible in water.

It is desirable, however, to use a thermosettable primer/surfacer coating to provide better adhesion to the substrate. Unfortunately, conventional thermosettable waterborne primer/surfacer compositions need to be cured before the basecoat is applied, increasing cost by requiring major capital investment in ovens and large amounts of energy.

The automotive industry would derive a significant economic advantage from an inexpensive coating process which provides a coated composite having good adhesion, chip resistance and smoothness, yet which can be applied wet-on-wet-on-wet ("WOWOW"), i.e., a process in which the primer/surfacer is not heated or is heated only for a short time at a low temperature to evaporate some of the water and/or solvent remaining in the primer/surfacer after it has been applied without significant crosslinking thereof.

SUMMARY OF THE INVENTION

The present invention provides a method for forming a composite coating comprising the steps of: (A) applying an aqueous primary coating composition to at least a portion of a surface of a substrate, the primary coating composition comprising: (1) at least one thermosettable dispersion comprising polymeric microparticles having functionality adapted to react with a crosslinking material, the microparticles comprising: (a) at least one acid functional reaction product of ethylenically unsaturated monomers; and (b) at least one hydrophobic polymer having a number average molecular weight of at least about 500; and (2) at least one crosslinking material, to form a substantially uncured primary coating thereon; (B) applying a secondary coating composition to at least a portion of the primary coating formed in step (A) without substantially curing the primary coating to form a substantially uncured secondary coating thereon; and (C) applying a clear coating composition to at least a portion of the secondary coating formed in step (B) without substantially curing the secondary coating to form a substantially uncured composite coating thereon.

DETAILED DESCRIPTION OF THE PREFERRED EMBODIMENTS

The method of the present invention provides a composite coating having good smoothness and aesthetic appearance, as well as good adhesion to the substrate and chip resistance. The methods comprise a first step (A) of applying an aqueous primary coating composition to at least a portion of a surface of a substrate.

The shape of the metal substrate can be in the form of a sheet, plate, bar, rod or any shape desired, but is preferably is in the form of an automobile part, such as a body, door, fender, hood or bumper. The thickness of the substrate can vary as desired. Suitable substrates can be formed from inorganic or metallic materials, thermoset materials, thermoplastic materials and combinations thereof.

The metal substrates coated by the methods of the present invention include ferrous metals such as iron, steel, and alloys thereof, non-ferrous metals such as aluminum, zinc and alloys thereof, and combinations thereof. Most load bearing components of automobile bodies are formed from metal substrates. Useful thermoset materials include polyesters, epoxides, phenolics, polyurethanes and mixtures thereof. Useful thermoplastic materials include polyolefins, polyamides, thermoplastic polyurethanes, thermoplastic polyesters, acrylic polymers, vinyl polymers, copolymers and mixtures thereof. Car parts typically formed from thermoplastic and thermoset materials include bumpers and trim. It is desirable to have a coating system which can be applied to both metal and non-metal parts.

To better understand the aforesaid important aspects of the invention, a metal coating operation in which such methods are useful will be discussed. One skilled in the art would understand that the methods of the present invention are not intended to be limited to use in coating metal substrates, but also are useful for coating polymeric substrates as discussed above.

Before depositing the coatings upon the surface of the metal substrate, it is preferred to remove foreign matter from the metal surface by thoroughly cleaning and degreasing the surface by physical or chemical means such as are well known to those skilled in the art. Preferably, a pretreatment coating, such as BONAZINC zinc-rich pretreatment (commercially available from PPG Industries, Inc.), is deposited upon at least a portion of the surface of the metal substrate.

An electrodeposited coating is preferably applied to the surface of an electroconductive substrate prior to applying the primary coating composition of step (A), which is discussed in detail below. Useful electrodepositable coating compositions include conventional anionic or cationic electrodepositable coating compositions. Methods for electrodepositing coatings are well known to those skilled in the art and a detailed discussion thereof is not believed to be necessary. Useful compositions and methods are discussed in U.S. Pat. No. 5,530,043 (relating to anionic electrodeposition) and U.S. Pat. Nos. 5,760,107; 5,820,987 and 4,933,056 (relating to cationic electrodeposition) which are hereby incorporated by reference.

In the methods of the present invention, an aqueous primary coating composition is applied to at least a portion of the substrate (which can be pretreated and/or electrocoated, as discussed above). The aqueous primary coating composition comprises, as a film former, at least one thermosettable or crosslinkable dispersion comprising polymeric microparticles having functionality adapted to react with a crosslinking material in an aqueous medium. As used herein, the term "dispersion" means that the microparticles are capable of being distributed throughout water as finely divided particles, such as a latex. See *Hawley's Condensed Chemical Dictionary,* (12th Ed. 1993) at page 435, which is hereby incorporated by reference. The uniformity of the dispersion can be increased by the addition of wetting, dispersing or emulsifying agents (surfactants), which are discussed below.

The microparticles comprise at least one acid functional reaction product (a) of ethylenically unsaturated monomers. As used herein, the phrase "acid functional" means that the product (a) can give up a proton to a base in a chemical reaction; a substance that is capable of reacting with a base to form a salt; or a compound that produces hydronium ions, $H_3O^+$, in aqueous solution. See *Hawley's* at page 15 and K. Whitten et al., *General Chemistry,* (1981) at page 192, which are hereby incorporated by reference.

The reaction product (a) is usually formed by polymerizing one or more ethylenically unsaturated carboxylic acid monomers (having a carboxyl group(s) as the acid functional group) and one or more other ethylenically unsaturated monomers.

One skilled in the art would understand the criteria for selecting suitable addition polymerizable unsaturated carboxylic acid monomers which are capable of forming a polymer with the other ethylenically unsaturated monomers. Such criteria can include, for example, structural characteristics and reactivity rate which are appropriate to form a polymer from the addition polymerizable unsaturated carboxylic acid monomers and the other ethylenically unsaturated monomers. Guidance in selecting appropriate addition polymerizable unsaturated carboxylic acids can be found in *Kirk-Othmer Encyclopedia of Chemical Technology,* Vol. 1 (1963) at pages 224–254.

Non-limiting examples of useful ethylenically unsaturated carboxylic acid monomers include acrylic acid, methacrylic acid, acryloxypropionic acid, crotonic acid, fumaric acid, monoalkyl esters of fumaric acid, maleic acid, monoalkyl esters of maleic acid, itaconic acid, monoalkyl esters of itaconic acid and mixtures thereof. Preferred ethylenically unsaturated carboxylic acid monomers are acrylic acid and methacrylic acid.

Non-limiting examples of useful other ethylenically unsaturated vinyl monomers include alkyl esters of acrylic and methacrylic acids, such as methyl acrylate, ethyl acrylate, methyl methacrylate, ethyl methacrylate, butyl acrylate, butyl methacrylate, 2-ethylhexyl acrylate, 2-ethylhexyl methacrylate, 2-hydroxyethyl acrylate, 2-hydroxyethyl methacrylate, hydroxypropyl methacrylate, ethylene glycol dimethacrylate, isobornyl methacrylate and lauryl methacrylate; vinyl aromatics such as styrene and vinyl toluene; acrylamides such as N-butoxymethyl acrylamide; acrylonitriles; dialkyl esters of maleic and fumaric acids; vinyl and vinylidene halides; vinyl acetate; vinyl ethers; allyl ethers; allyl alcohols; derivatives thereof and mixtures thereof. Acrylic monomers such as butyl acrylate, lauryl methacrylate, or 2-ethylhexyl acrylate are preferred due to the hydrophobic, low glass transition temperature ($T_g$) nature of the polymers that they produce.

The reaction product (a) can be formed by free radical-initiated polymerization, preferably in the presence of the hydrophobic polymer (b), which is discussed in detail below. Alternatively, the reaction product (a) can be polymerized and dispersed as a mixture with the hydrophobic polymer (b) in an aqueous medium by conventional dispersion techniques which are well known to those skilled in the art.

Suitable methods for polymerizing ethylenically unsaturated monomers with themselves and/or other addition polymerizable monomers and preformed polymers are well known to those skilled in the art of polymers and further discussion thereof is not believed to be necessary in view of the present disclosure. For example, polymerization of the ethylenically unsaturated monomers can be carried out in bulk, in aqueous or organic solvent solution such as benzene or n-hexane, in emulsion, or in aqueous dispersion. *Kirk-Othmer,* Vol. 1 at page 305. The polymerization can be effected by means of a suitable initiator system, including free radical initiators such as benzoyl peroxide or azobisisobutyronitrile, anionic initiation and organometallic initiation. Molecular weight can be controlled by choice of solvent or polymerization medium, concentration of initiator or monomer, temperature, and the use of chain transfer agents. If additional information is needed, such polymerization methods are disclosed in *Kirk-Othmer,* Vol. 1 at pages 203–205, 259–297 and 305–307, which are hereby incorporated by reference.

The number average molecular weight of the reaction product (a) can range from about 10,000 to about 10,000,000 grams per mole, and preferably about 50,000 to about 500,000 grams per mole. The term "molecular weight" refers to a number average molecular weight as determined by gel permeation chromatography using a polystyrene standard. Therefore, it is not an absolute number average molecular weight which is measured, but a number average molecular weight which is a measure relative to a set of polystyrene standards.

The glass transition temperature of the reaction product (a) can range from about −50° C. to about +100° C., preferably about 0° C. to about +50° C. as measured using a Differential Scanning Calorimeter (DSC), for example a Perkin Elmer Series 7 Differential Scanning Calorimeter, using a temperature range of about −55° C. to about 150° C. and a scanning rate of about 20° C. per minute.

The amount of the reaction product (a) ranges from about 10 to about 80 weight percent on a basis of total resin solids weight of the thermosettable dispersion, preferably about 20 to about 60 weight percent, and more preferably about 30 to about 50 weight percent.

The microparticles also comprise one or more hydrophobic polymers. As used herein, "hydrophobic polymer" means hydrophobic oligomers, polymers and copolymers. The term "hydrophobic", as used herein, means that the polymer essentially is not compatible with, does not have an affinity for and/or is not capable of dissolving in water, i.e., it repels water, and that upon mixing a sample of polymer with an organic component and water, a majority of the polymer is in the organic phase and a separate aqueous phase is observed. See *Hawley's Condensed Chemical Dictionary,* (12th Ed. 1993) at page 618. In order for the hydrophobic polymer to be substantially hydrophobic the hydrophobic polymer must not contain enough acid or ionic functionality to allow it to form stable dispersions in water. The amount of acid functionality in a resin can be measured by acid value, the number of milligrams of KOH per gram of solid required to neutralize the acid functionality in the resin. Preferably, the acid value of the hydrophobic polymer is below about 20, more preferably the acid value is below about 10, and most preferably below about 5. Hydrophobic polymers having low acid values can be water-dispersible if they contain other hydrophilic components such as poly (ethylene oxide) groups. However, such hydrophobic polymers are not substantially hydrophobic if they are water-dispersible, no matter what their acid value is.

The hydrophobic polymer is adapted to be chemically bound into the composite coating when it is cured, i.e., the hydrophobic polymer is reactive in the sense that it contains functional groups such as hydroxyl groups which are capable of coreacting, for example, with a crosslinking agent such as melamine formaldehyde which may be present in the primary coating composition or alternatively with other film forming resins which also can be present.

Preferably, the hydrophobic polymer has a number average molecular weight greater than 500, more preferably greater than 800. Typically the molecular weight ranges from about 800 to about 10,000, more usually from about 800 to about 3000. The glass transition temperature of the hydrophobic polymer can range from about −50° C. to about +50° C., and preferably about −25° C. to about +25° C.

The hydrophobic polymer is preferably essentially linear, i. e., it contains a minimal amount of branching for flexibility. The hydrophobic polymer preferably is essentially free of repeating acrylic or vinyl units, i.e., the polymer is not prepared from typical free radically polymerizable monomers such as acrylates, styrene and the like.

Non-limiting examples of useful hydrophobic polymers include polyesters, alkyds, polyurethanes, polyethers, polyureas, polyamides, polycarbonates and mixtures thereof.

Suitable polyester resins are derived from polyfunctional acids and polyhydric alcohols. Generally, polyester resins contain essentially no oil or fatty acid modification. That is, while alkyd resins are in the broadest sense polyester type resins, they are oil-modified and thus not generally referred to as polyester resins. Commonly used polyhydric alcohols include 1,4-butanediol, 1,6-hexanediol, neopentyl glycol, ethylene glycol, propylene glycol, diethylene glycol, dipropylene glycol, butylene glycol, glycerol, trimethylolpropane, pentaerythritol and sorbitol. A saturated acid often will be included in the reaction to provide desirable properties. Examples of saturated acids include phthalic acid, isophthalic acid, adipic acid, azeleic acid, sebacic acid and the anhydrides thereof. Useful saturated polyesters are derived from saturated or aromatic polyfunctional acids, preferably dicarboxylic acids, and mixtures of polyhydric alcohols having an average hydroxyl functionality of at least 2. Mixtures of rigid and flexible diacids are preferable in order to achieve a balance of hardness and flexibility. Monocarboxylic acids such as benzoic acid can be used in addition to polycarboxylic acids in order to improve properties or modify the molecular weight or the viscosity of the polyester. Dicarboxylic acids or anhydrides such as isophthalic acid, phthalic anhydride, adipic acid, and maleic anhydride are preferred. Other useful components of polyesters can include hydroxy acids and lactones such as ricinoleic acids, 12-hydroxystearic acid, caprolactone, butyrolactone and dimethylolpropionic acid.

Polyols having a hydroxyl functionality of two such as neopentylglycol, trimethylpentanediol, or 1,6-hexanediol are preferred. Small amounts of polyols with a functionality greater than two such as pentaerythritol, trimethylolpropane, or glycerol and monofunctional alcohols such as tridecyl alcohol, in addition to diols, can be used to improve properties of the polyester.

Suitable polyurethane resins can be prepared by reacting a polyol with a polyisocyanate. The reaction can be performed with a minor amount of organic polyisocyanate (OH/NCO equivalent ratio greater than 1:1) so that terminal hydroxyl groups are present or alternatively the OH/NCO equivalent ratio can be less than 1:1 thus producing terminal isocyanate groups. Preferably the polyurethane resins have terminal hydroxyl groups.

The organic polyisocyanate can be an aliphatic polyisocyanate, including a cycloaliphatic polyisocyanate, or an aromatic polyisocyanate. Useful aliphatic polyisocyanates include aliphatic diisocyanates such as ethylene diisocyanate, 1,2-diisocyanatopropane, 1,3-diisocyanatopropane, 1,6-diisocyanatohexane, 1,4-butylene diisocyanate, lysine diisocyanate, 1,4-methylene bis (cyclohexyl isocyanate) and isophorone diisocyanate. Useful aromatic diisocyanates and araliphatic diisocyanates include the various isomers of toluene diisocyanate, meta-xylylene diisocyanate and para-xylylene diisocyanate, also 4-chloro-1,3-phenylene diisocyanate, 1,5-tetrahydronaphthalene diisocyanate, 4,4'-dibenzyl diisocyanate and 1,2,4-benzene triisocyanate can be used. In addition the various isomers of alpha, alpha, alpha', alpha'-tetramethyl xylylene diisocyanate can be used. Also useful as the polyisocyanate are isocyanurates such as DESMODUR 3300 and biurets of isocyanates such as DESMODUR N100, both of which are commercially available from Bayer, Inc. of Pittsburgh, Pa.

The polyol can be polymeric such as polyester polyols, polyether polyols, polyurethane polyols, etc. or it can be a simple diol or triol such as ethylene glycol, propylene glycol, butylene glycol, glycerol, trimethylolpropane or hexanetriol. Mixtures can also be utilized.

The polyester or polyurethane can be adapted so that a portion of it can be grafted onto an acrylic and/or vinyl polymer. That is, the polyester or polyurethane can be chemically bound to an ethylenically unsaturated component that is capable of undergoing free radical copolymerization with acrylic and/or vinyl monomers. One means of making the polyester or polyurethane graftable is by including in its composition an ethylenically unsaturated acid or anhydride such as crotonic acid, maleic anhydride, or methacrylic anhydride. For example, an isocyanate-functional 1:1 adduct of hydroxyethyl methacrylate and isophorone diisocyanate can be reacted with hydroxyl functionality in the polyurethane to make it copolymerizable with acrylic monomers.

Useful alkyd resins include polyesters of polyhydroxyl alcohols and polycarboxylic acids chemically combined with various drying, semi-drying and non-drying oils in different proportions. Thus, for example, the alkyd resins are made from polycarboxylic acids such as phthalic acid, maleic acid, fumaric acid, isophthalic acid, succinic acid, adipic acid, azeleic acid, sebacic acid as well as from anhydrides of such acids, where they exist. The polyhydric alcohols which can be reacted with the polycarboxylic acid include 1,4-butanediol, 1,6-hexanediol, neopentyl glycol, ethylene glycol, diethylene glycol and 2,3-butylene glycol, glycerol, trimethylolpropane, pentaerythritol, sorbitol and mannitol.

The alkyd resins are produced by reacting the polycarboxylic acid and the polyhydric alcohol together with a drying, semi-drying or non-drying oil in proportions depending upon the properties desired. The oils are coupled into the resin molecule by esterification during manufacturing and become an integral part of the polymer. The oil is fully saturated or predominately unsaturated. When cast into films, fully saturated oils tend to give a plasticizing effect to the film, whereas predominately unsaturated oils tend to crosslink and dry rapidly with oxidation to give more tough and solvent resistant films. Suitable oils include coconut oil, fish oil, linseed oil, tung oil, castor oil, cottonseed oil, safflower oil, soybean oil, and tall oil. Various proportions of the polycarboxylic acid, polyhydric alcohol and oil are used to obtain alkyd resins of various properties as is well known in the art.

Examples of useful polyethers are polyalkylene ether polyols which include those having the following structural formulae:

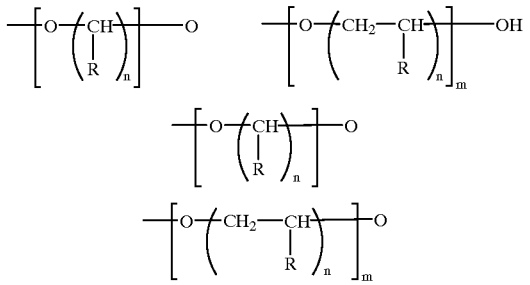

where the substituent R is hydrogen or lower alkyl containing from 1 to 5 carbon atoms including mixed substituents, n is an integer typically ranging from 2 to 6 and m is an integer ranging from 10 to 100 or even higher. Non-limiting examples of useful polyalkylene ether polyols include poly (oxytetramethylene) glycols, poly(oxy-1,2-propylene) glycols and poly(oxy-1,2-butylene) glycols.

Also useful are polyether polyols formed from oxyalkylation of various polyols, for example, glycols such as ethylene glycol, 1,6-hexanediol, Bisphenol A and the like, or other higher polyols, such as trimethylolpropane, pentaerythritol and the like. Polyols of higher functionality which can be utilized as indicated can be made, for example, by oxyalkylation of compounds such as sorbitol or sucrose. One commonly utilized oxyalkylation method is by reacting a polyol with an alkylene oxide, for example, ethylene or propylene oxide, in the presence of an acidic or basic catalyst.

With polyether polyols, it is preferred that the carbon to oxygen weight ratio be high for better hydrophobic properties. Thus, it is preferred that the carbon to oxygen ratio be greater than 3/1 and more preferably greater than 4/1.

The hydrophobic polymer of the polymeric microparticles can optionally contain other components included to modify certain of its properties. For example, the hydrophobic polymer can contain urea or amide functionality to improve adhesion. Suitable urea functional hydrophobic polymers include acrylic polymers having pendant urea groups, which can be prepared by copolymerizing acrylic monomers with urea functional vinyl monomers such as urea functional alkyl esters of acrylic acid or methacrylic acid. An example includes the condensation product of acrylic acid or methacrylic acid with a hydroxyalkyl ethylene urea such as hydroxyethyl ethylene urea. Other urea functional monomers include, for example, the reaction product of hydroxyethyl methacrylate, isophorone diisocyanate and hydroxyethyl ethylene urea. Mixed pendant carbamate and urea groups can also be used.

Other useful urea functional hydrophobic polymers include polyesters having pendant urea groups, which can be prepared by reacting a hydroxyl functional urea, such as hydroxyalkyl ethylene urea, with the polyacids and polyols used to form the polyester. A polyester oligomer can be prepared by reacting a polyacid with a hydroxyl functional urea. Also, isocyanate-terminated polyurethane or polyester prepolymers can be reacted with primary amines, aminoalkyl ethylene urea or hydroxyalkyl ethylene urea to yield materials with pendant urea groups. Preparation of these polymers is known in the art and is described in U.S. Pat. No. 3,563,957.

Useful polyamides include acrylic polymers having pendant amide groups. Pendant amide groups can be incorporated into the acrylic polymer by co-polymerizing the acrylic monomers with amide functional monomers such as (meth) acrylamide and N-alkyl (meth)acrylamides including N-t-butyl (meth)acrylamide, N-t-octyl (meth)acrylamide, N-isopropyl (meth)acrylamide, and the like. Alternatively, amide functionality may be incorporated into the polymer by post-reaction, for example, by first preparing an acid functional polymer, such as an acid functional polyester or polyurethane, and then reacting the acid functional polymer with ammonia or an amine using conventional amidation reaction conditions, or, alternatively, by preparing a polymer having pendant ester groups (such as by using alkyl (meth) acrylates) and reacting the polymer with ammonia or a primary amine.

Pendant amide functional groups can be incorporated into a polyester polymer by preparing a carboxylic acid functional polyester and reacting with ammonia or amine using conventional amidation conditions.

The amount of the hydrophobic polymer(s) can range from about 20 to about 90 weight percent on a basis of total solids weight of the thermosettable dispersion, preferably about 40 to about 80 weight percent, and more preferably about 50 to about 70 weight percent.

In a preferred embodiment, the dispersion of polymeric microparticles in an aqueous medium is prepared by a high stress technique which is described more fully below. First, the ethylenically unsaturated monomers utilized to prepare the microparticle are thoroughly mixed with the aqueous medium and the hydrophobic polymer. For the present application, the ethylenically unsaturated monomers together with the hydrophobic polymer are referred to as the organic component. The organic component generally also comprises other organic species and preferably is substantially free of organic solvent, i.e., no more than 20 percent of organic solvent is present. The mixture is then subjected to stress in order to particulate it into microparticles which are uniformly of a fine particle size. The mixture is subjected to stress sufficient to result in a dispersion such that after polymerization less than 20 percent of the polymer microparticles have a mean diameter greater than 5 microns.

The aqueous medium provides the continuous phase of dispersion in which the microparticles are suspended. The aqueous medium is generally exclusively water. However, for some polymer systems, it can be desirable to also include a minor amount of inert organic solvent which can assist in lowering the viscosity of the polymer to be dispersed. For example, if the organic phase has a Brookfield viscosity greater than 1000 centipoise at 25° C. or a W Gardner Holdt viscosity, some solvent can be used. Examples of suitable solvents which can be incorporated in the organic component are benzyl alcohol, xylene, methyl isobutyl ketone, mineral spirits, butanol, butyl acetate, tributyl phosphate and dibutyl phthalate.

As was mentioned above, the mixture is subjected to the appropriate stress by use of a MICROFLUIDIZER® emulsifier which is available from Microfluidics Corporation in Newton, Mass. The MICROFLUIDIZER® high pressure impingement emulsifier is disclosed in U.S. Pat. No. 4,533,254, which is hereby incorporated by reference. The device consists of a high pressure (up to about $1.4\times10^5$ kPa (20,000 psi)) pump and an interaction chamber in which emulsification takes place. The pump forces the mixture of reactants in aqueous medium into the chamber where it is split into at least two streams which pass at very high velocity through at least two slits and collide, resulting in the particulation of the mixture into small particles. Generally, the reaction mixture is passed through the emulsifier once at a pressure of between about $3.5\times10^4$ and about $1\times10^5$ kPa (5,000 and 15,000 psi). Multiple passes can result in smaller average particle size and a narrower range for the particle size distribution. When using the aforesaid MICROFLUIDIZER® emulsifier, stress is applied by liquid-liquid impingement as has been described. However, it should be understood that, if desired, other modes of applying stress to the pre-emulsification mixture can be utilized so long as sufficient stress is applied to achieve the requisite particle size distribution, that is, such that after polymerization less than 20 percent of the polymer microparticles have a mean diameter greater than 5 microns. For example, one alternative manner of applying stress would be the use of ultrasonic energy.

Stress is described as force per unit area. Although the precise mechanism by which the MICROFLUIDIZER® emulsifier stresses the pre-emulsification mixture to particulate it is not thoroughly understood, it is theorized that stress is exerted in more than one manner. It is believed that one manner in which stress is exerted is by shear. Shear means that the force is such that one layer or plane moves parallel to an adjacent, parallel plane. Stress can also be exerted from all sides as a bulk, compression stress. In this instance stress could be exerted without any shear. A further manner of producing intense stress is by cavitation. Cavitation occurs when the pressure within a liquid is reduced enough to cause vaporization. The formation and collapse of the vapor bubbles occurs violently over a short time period and produces intense stress. Although not intending to be bound by any particular theory, it is believed that both shear and cavitation contribute to producing the stress which particulates the pre-emulsification mixture.

Once the mixture has been particulated into microparticles, the polymerizable species within each particle are polymerized under conditions sufficiently to produce polymer microparticles which are stably dispersed in the aqueous medium. Preferably, a surfactant or dispersant is present to stabilize the dispersion. The surfactant is preferably present when the organic component referred to above is mixed into the aqueous medium prior to particulation. Alternatively, the surfactant can be introduced into the medium at a point just after the particulation within the MICROFLUIDIZER® emulsifier. The surfactant, however, can be an important part of the particle forming process and is often necessary to achieve the requisite dispersion stability. The surfactant can be a material whose role is to prevent the emulsified particles from agglomerating to form larger particles.

Examples of suitable surfactants include the dimethylethanolamine salt of dodecylbenzenesulfonic acid, sodium dioctylsulfosuccinate, ethoxylated nonylphenol and sodium dodecyl benzene sulfonate. Other materials well known to those skilled in the art are also suitable herein. Generally, both ionic and non-ionic surfactants are used together and the amount of surfactant ranges from about 1 percent to about 10 percent, preferably from about 2 percent to about 4 percent, the percentage based on the total solids. One particularly preferred surfactant for the preparation of aminoplast curable dispersions is the dimethylethanolamine salt of dodecylbenzenesulfonic acid.

In order to conduct the polymerization of the ethylenically unsaturated monomers, a free radical initiator is usually present. Both water soluble and oil soluble initiators can be used. Since the addition of certain initiators, such as redox initiators, can result in a strong exothermic reaction, it is generally desirable to add the initiator to the other ingredients immediately before the reaction is to be conducted. Examples of water soluble initiators include ammonium peroxydisulfate, potassium peroxydisulfate and hydrogen peroxide. Examples of oil soluble initiators include t-butyl hydroperoxide, dilauryl peroxide, t-butyl perbenzoate and 2,2'-azobis(isobutyronitrile). Preferably redox initiators such as ammonium peroxydisulfate/sodium metabisulfite or t-butylhydroperoxide/isoascorbic acid are utilized herein.

It should be understood that in some instances it can be desirable for some of the reactant species to be added after particulation of the remaining reactants and the aqueous medium, for example, water soluble acrylic monomers such as hydroxypropyl methacrylate.

The particulated mixture is then subjected to conditions sufficient to induce polymerization of the polymerizable species within the microparticles. The particular conditions will vary depending upon the actual materials being polymerized. The length of time required to complete polymerization typically varies from about 10 minutes to about 6 hours. The progress of the polymerization reaction can be followed by techniques conventionally known to those skilled in the art of polymer chemistry. For example, heat generation, monomer concentration and percent of total solids are all methods of monitoring the progress of the polymerization.

The aqueous microparticle dispersions can be prepared by a batch process or a continuous process. In one example of a batch process, the unreacted microdispersion is fed over a period of about 1 to 4 hours into a heated reactor initially charged with water. The initiator can be fed in simultaneously, it can be part of the microdispersion or it can be charged to the reactor before feeding in the microdispersion. The optimum temperature depends upon the specific initiator being used. The length of time typically ranges from about 2 hours to about 6 hours.

In an alternative batch process, a reactor vessel is charged with the entire amount of microdispersion to be polymerized. Polymerization commences when an appropriate initiator such as a redox initiator is added. An appropriate initial temperature is chosen such that the heat of polymerization does not increase the batch temperature beyond the boiling point of the ingredients. Thus for large scale production, it is preferred that the microdispersion have sufficient heat capacity to absorb the total amount of heat being generated.

In a continuous process, the pre-emulsion or mixture of raw materials is passed through the homogenizer to make a microdispersion which is immediately passed through a heated tube, e.g., stainless steel, or a heat exchanger in which polymerization takes place. The initiator is added to the microdispersion just before it enters the tubing.

It is preferred to use redox type initiators in the continuous process since other initiators can produce gases such as nitrogen or carbon dioxide which can cause the latex to spurt out of the reaction tubing prematurely. The temperature of reaction can range from about 25° C. to about 80° C., preferably about 35° C. to about 45° C. The residence time typically ranges from about 5 minutes to about 30 minutes.

The tubing in which the reaction occurs is not required to heat the microdispersion but rather to remove the heat being generated. Once the initiator has been added, the reaction begins spontaneously after a short induction period and the reaction exotherm resulting from the polymerization will rapidly raise the temperature.

If there is still free monomer remaining after all of the initiator is consumed, an additional amount of initiator can be added to scavenge the remaining monomer.

Once the polymerization is complete, the resultant product is a stable dispersion of polymer microparticles in an aqueous medium, wherein both the polymer formed from the ethylenically unsaturated monomers and the substantially hydrophobic polymer are contained within each microparticle. The aqueous medium, therefore, is substantially free of water soluble polymer. The resultant polymer microparticles are, of course, insoluble in the aqueous medium. As used herein, "substantially free" means that the aqueous medium contains no more than 30 percent by weight of dissolved polymer, preferably no more than 15 percent.

By "stably dispersed" is meant that the polymer microparticles do not settle upon standing and do not coagulate or flocculate on standing. Typically, when diluted to 50 percent total solids, the microparticle dispersions do not settle even when aged for one month at room temperature.

As was stated above, a very important aspect of the polymer microparticle dispersions is that the particle size is uniformly small, i.e., after polymerization less than 20 percent of the polymer microparticles have a mean diameter which is greater than 5 microns, more preferably greater than 1 micron. Generally, the microparticles have a mean diameter from about 0.01 microns to about 10 microns. Preferably the mean diameter of the particles after polymerization ranges from about 0.05 microns to about 0.5 microns. The particle size can be measured with a particle size analyzer such as the Coulter N4 instrument commercially available from Coulter. The instrument comes with detailed instructions for making the particle size measurement. However, briefly, a sample of the aqueous dispersion is diluted with water until the sample concentration falls within specified limits required by the instrument. The measurement time is 10 minutes.

The microparticle dispersions are high solids materials of low viscosity. Dispersions can be prepared directly with a total solids content of from about 45 percent to about 60 percent. They can also be prepared at a lower solids level of about 30 to about 40 percent total solids and concentrated to a higher level of solids of about 55 to about 65 percent by stripping. The molecular weight of the polymer and viscosity of the claimed aqueous dispersions are independent of each other. The weight average molecular weight can range from a few hundred to greater than 100,000. The Brookfield viscosity can also vary widely from about 0.01 poise to about 100 poise, depending on the solids and composition, preferably from about 0.2 to about 5 poise when measured at 25° C. using an appropriate spindle at 50 RPM.

The microparticle can be either crosslinked or uncrosslinked. When uncrosslinked the polymer(s) within the microparticle can be either linear or branched. The polymeric microparticle may or may not be internally crosslinked. When the microparticles are internally crosslinked, they are referred to as a microgel. Monomers used in preparing the microparticle so as to render it internally crosslinked include those ethylenically unsaturated monomers having more than one site of unsaturation, such as ethylene glycol dimethacrylate, which is preferred, allyl methacrylate, hexanediol diacrylate, methacrylic anhydride, tetraethylene glycol diacrylate, tripropylene glycol diacrylate, and the like. A low degree of crosslinking, such as would be obtained when one to three percent by weight of the total latex polymer is ethylene glycol dimethacrylate, is preferred.

Microparticles can have a core/shell morphology if suitable hydrophilic ethylenically unsaturated monomer(s) are included in the mixture of monomer(s) used to produce reaction product (a) and the hydrophobic polymer. Due to its hydrophobic nature, the hydrophobic polymer will tend to be incorporated into the interior, or core, of the microparticle and the hydrophilic monomer(s) will tend to be incorporated into the exterior, or shell, of the microparticles. Suitable hydrophilic monomers include, for example, acrylic acid, methacrylic acid, vinyl acetate, N-methylol acrylamide, hydroxyethyl acrylate, and hydroxypropyl methacrylate. As mentioned in U.S. Pat. No. 5,071,904, it may be desirable to add water soluble monomer(s) after the other components of the dispersion of polymeric microparticles have been particularized into microparticles.

Acrylic acid is a particularly useful hydrophilic monomer for use in the present invention. In order to obtain the advantages of a high solids waterborne coating composition, the coating composition should have sufficiently low viscosity to allow adequate atomization of the coating during spray application. The viscosity of the primary coating composition can be controlled partially by choosing components and reaction conditions that control the amount of hydrophilic polymer in the aqueous phase and in the shell of the polymeric microparticles. Interactions among microparticles, and consequently the rheology of coatings containing them, are greatly affected by the ionic charge density on the surface of the microparticles. Charge density can be increased by increasing the amount of acrylic acid polymerized into the shell of a microparticle. The amount of acrylic acid incorporated into the shell of a microparticle can also be increased by increasing the pH of the aqueous medium in which the polymerization takes place.

Dispersions of polymeric microparticles containing more than about 5 percent by weight of acrylic acid, or having an acid value greater than 40 if acid functional monomers other than acrylic acid are used, are generally too viscous to provide high solids coating compositions. The preferred amount of acrylic acid is generally between about 1 and about 3 percent by weight of the total polymer in the dispersion or latex. Therefore, the acid value of the polymer in the dispersion of polymeric microparticles is preferably between about 8 and about 24.

In an alternative embodiment discussed briefly above, the reaction product (a) and hydrophobic polymer can be mixed without the use of a MICROFLUIDIZER® as follows. For low number average molecular weight hydrophobic polymers (between about 500 and about 800), the polymerized reaction product (a) and hydrophobic polymer are mixed together using conventional mixing techniques which are well known to those skilled in the art. Higher number average molecular weight hydrophobic polymers (greater than about 800) are preferably pre-dissolved in a coupling solvent such as the monobutyl ether of ethylene glycol and mixed with the polymerized reaction product (a) using conventional mixing techniques well known to those skilled in the art, such as high shear mixing techniques.

The amount of the thermosettable dispersion in the primary coating composition can range from about 30 to about 90 weight percent on a basis of total resin solids of the primary coating composition, and preferably from about 50 to about 70 weight percent.

The primary coating composition also comprises one or more crosslinking materials which are adapted to cure the polymeric microparticles. Non-limiting examples of suitable crosslinking materials include aminoplasts, polyisocyanates, polyacids, polyanhydrides and mixtures thereof. The crosslinking material or mixture of crosslinking materials used in the primary coating composition is dependent upon the functionality associated with the polymer microparticles. Preferably, the functionality is hydroxyl and the crosslinking material is an aminoplast or isocyanate.

Aminoplast resins are based on the addition products of formaldehyde, with an amino- or amido-group carrying substance. Condensation products obtained from the reaction of alcohols and formaldehyde with melamine, urea or benzoguanamine are most common and preferred herein. However, condensation products of other amines and amides can also be employed, for example, aldehyde condensates of triazines, diazines, triazoles, guanadines, guanamines and alkyl- and aryl-substituted derivatives of such compounds, including alkyl- and aryl-substituted ureas and alkyl- and aryl-substituted melamines. Some examples of such compounds are N,N'-dimethyl urea, benzourea, dicyandiamide, formaguanamine, acetoguanamine, glycoluril, ammeline, 2-chloro-4,6-diamino-1,3,5-triazine, 6-methyl-2,4-diamino-1,3,5-triazine, 3,5-diaminotriazole, triaminopyrimidine, 2-mercapto-4,6-diaminopyrimidine, 3,4,6-tris(ethylamino)-1,3,5 triazine, and the like.

While the aldehyde employed is most often formaldehyde, other similar condensation products can be made from other aldehydes, such as acetaldehyde, crotonaldehyde, acrolein, benzaldehyde, furfural, glyoxal and the like.

The aminoplast resins preferably contain methylol or similar alkylol groups, and in most instances at least a portion of these alkylol groups are etherified by a reaction with an alcohol to provide organic solvent-soluble resins. Any monohydric alcohol can be employed for this purpose, including such alcohols as methanol, ethanol, propanol, butanol, pentanol, hexanol, heptanol and others, as well as benzyl alcohol and other aromatic alcohols, cyclic alcohols such as cyclohexanol, monoethers of glycols, and halogen-substituted or other substituted alcohols, such as 3-chloropropanol and butoxyethanol. The preferred aminoplast resins are substantially alkylated with methanol or butanol.

The polyisocyanate which is utilized as a crosslinking agent can be prepared from a variety of polyisocyanates. Preferably the polyisocyanate is a blocked diisocyanate. Examples of suitable diisocyanates which can be utilized herein include toluene diisocyanate, 4,4'-methylene-bis (cyclohexyl isocyanate), isophorone diisocyanate, an isomeric mixture of 2,2,4- and 2,4,4-trimethyl hexamethylene diisocyanate, 1,6-hexamethylene diisocyanate, tetramethyl xylylene diisocyanate and 4,4'-diphenylmethylene diisocyanate. In addition, blocked polyisocyanate prepolymers of various polyols such as polyester polyols can also be used. Examples of suitable blocking agents include those materials which would unblock at elevated temperatures including lower aliphatic alcohols such as methanol, oximes such as methyl ethyl ketoxime and lactams such as caprolactam.

Polyacid crosslinking materials suitable for use in the present invention on average generally contain greater than one acid group per molecule, more preferably three or more and most preferably four or more, such acid groups being reactive with epoxy functional film-forming polymers. Preferred polyacid crosslinking materials have di-, tri- or higher functionalities. Suitable polyacid crosslinking materials which can be used include carboxylic acid group-containing oligomers, polymers and compounds, such as acrylic polymers, polyesters, and polyurethanes and compounds having phosphorus-based acid groups.

Examples of suitable polyacid crosslinking materials include ester group-containing oligomers and compounds including half-esters formed from reacting polyols and cyclic 1,2-acid anhydrides or acid functional polyesters derived from polyols and polyacids or anhydrides. These half-esters are of relatively low molecular weight and are quite reactive with epoxy functionality. Suitable ester group-containing oligomers are described in U.S. Pat. No. 4,764,430, column 4, line 26 to column 5, line 68, which is hereby incorporated by reference.

Other useful crosslinking materials include acid-functional acrylic crosslinkers made by copolymerizing methacrylic acid and/or acrylic acid monomers with other ethylenically unsaturated copolymerizable monomers as the polyacid crosslinking material. Alternatively, acid-functional acrylics can be prepared from hydroxy-functional acrylics reacted with cyclic anhydrides.

The amount of the crosslinking material in the primary coating composition generally ranges from about 5 to about 50 weight percent on a basis of total resin solids weight of the primary coating composition, preferably about 10 to about 35 weight percent, and more preferably about 10 to about 20 weight percent.

The primary coating composition can contain, in addition to the components described above, a variety of other optional materials. If desired, other resinous materials can be utilized in conjunction with the dispersion of polymeric microparticles so long as the resultant coating composition is not detrimentally affected in terms of physical performance and properties. In addition, materials such as rheology control agents, ultraviolet light stabilizers, catalysts and the like can be present. These materials can constitute up to 30 percent by weight of the total weight of the primary coating composition. The primary coating composition can also include fillers such as barytes, talc and clays in amounts up to about 70 percent by weight based on total weight of the coating composition.

The primary coating composition can further comprise pigments to give it color. Pigments conventionally used in primer coatings include inorganic pigments such as titanium dioxide, chromium oxide, lead chromate, and carbon black, and organic pigments such as phthalocyanine blue and phthalocyanine green. Mixtures of the above mentioned pigments can also be used. In general, the pigment is incorporated into the primary coating composition in amounts of about 20 to 70 percent, usually about 30 to 50 percent by weight based on total weight of the coating composition.

The solids content of the primary coating composition ranges from about 40 to about 70 weight percent on a basis of total weight of the primary coating composition, preferably about 45 to about 65 weight percent, and more preferably about 50 to about 60 weight percent.

The primary coating composition can applied to the surface of the substrate in step (A) by any suitable coating process well known to those skilled in the art, for example by dip coating, direct roll coating, reverse roll coating, curtain coating, spray coating, brush coating and combinations thereof. The method and apparatus for applying the primary coating composition to the substrate is determined in part by the configuration and type of substrate material.

The amount of the primary coating composition applied to the substrate can vary based upon such factors as the type of substrate and intended use of the substrate, i.e., the environment in which the substrate is to be placed and the nature of the contacting materials.

The primary coating composition has good leveling and flow characteristics. The primary coating composition also has excellent cure response and humidity resistance, as well as low volatile organic content. Generally, the volatile organic content is less than about 30 weight percent based upon the total weight of the primary coating composition, usually less than about 20 weight percent, and preferably less than about 10 weight percent.

During application of the primary coating composition to the substrate, ambient relative humidity generally can range from about 30 to about 80 percent, preferably about 50 percent to 70 percent.

A substantially uncured primary coating of the primary coating composition is formed on the surface of the substrate during application of the primary coating composition to the substrate. Typically, the coating thickness of the primary coating after final drying and curing of the multilayer composite coating ranges from about 0.4 to about 2 mils (about 10 to about 50 micrometers), and preferably about 0.7 to about 1.2 mils (about 18 to about 30 micrometers).

As used herein, "substantially uncured primary coating" means that the primary coating composition, after application to the surface of the substrate, forms a film which is substantially uncrosslinked, i.e., is not heated to a temperature sufficient to induce significant crosslinking and there is substantially no chemical reaction between the thermosettable dispersion and the crosslinking material.

After application of the aqueous primary coating composition to the substrate, the primary coating can be at least partially dried in an additional step (A') by evaporating water and solvent (if present) from the surface of the film by air drying at ambient (about 25° C.) or an elevated temperature for a period sufficient to dry the film but not significantly crosslink the components of the primary coating. The heating is preferably only for a short period of time sufficient to ensure that a secondary coating composition or basecoat can be applied over the primary coating essentially without dissolving the primary coating. Suitable drying conditions will depend on the components of the primary coating and on the ambient humidity, but in general a drying time of about 1 to about 5 minutes at a temperature of about 80° F. to about 250° F. (about 20° C. to about 121° C.) will be adequate to ensure that mixing of the primary coating and the secondary coating composition is minimized. Preferably, the drying temperature ranges from about 20° C. to about 80° C., and more preferably about 20° C. to about 50° C. Also, multiple primary coating compositions can be applied to develop the optimum appearance. Usually between coats, the previously applied coat is flashed; that is, exposed to ambient conditions for about 1 to 20 minutes.

A secondary coating composition is applied to at least a portion of a surface of the primary coating in a wet-on-wet application without substantially curing the primary coating to form a substantially uncured secondary coating, composed of the primary coating and secondary coating composition, thereon. The secondary coating composition can be applied to the surface of the primary coating by any of the coating processes discussed above for applying the primary coating composition.

Preferably, the secondary coating composition is present as a basecoat which includes a film-forming material or binder and pigment. The secondary coating composition can be a waterborne coating, solventborne coating or powder coating, as desired, but is preferably a waterborne coating. Preferably the secondary coating composition is a crosslinkable coating comprising at least one thermosettable film-forming material and at least one crosslinking material, although thermoplastic film-forming materials such as polyolefins can be used.

Suitable resinous binders for organic solvent-based base coats are disclosed in U.S. Pat. No. 4,220,679 at column 2, line 24 through column 4, line 40 and U.S. Pat. No. 5,196,485 at column 11, line 7 through column 13, line 22. Suitable waterborne base coats for color-plus-clear composites are disclosed in U.S. Pat. No. 4,403,003 and the resinous compositions used in preparing those base coats can be used in the present invention. Also, waterborne polyurethanes such as those prepared in accordance with U.S. Pat. No. 4,147,679 can be used as the resinous binder in the basecoat. Further, waterborne coatings such as those described in U.S. Pat. No. 5,071,904 can be used as the basecoat. Each of the patents discussed above is incorporated by reference herein. Other useful film-forming materials for the secondary coating composition include the hydrophobic polymers and/or reaction product (a) discussed above. Other components of the secondary coating composition can include crosslinking materials and additional ingredients such as pigments discussed above. Useful metallic pigments include aluminum flake, bronze flakes, coated mica, nickel flakes, tin flakes, silver flakes, copper flakes and combinations thereof. Other suitable pigments include mica, iron oxides, lead oxides, carbon black, titanium dioxide and talc. The specific pigment to binder ration can vary widely so long as it provides the requisite hiding at the desired film thickness and application solids. Preferably the secondary coating composition is chemically different or contains different relative amounts of ingredients from the primary coating composition, although the primary coating composition can be the same as the secondary coating composition.

The solids content of the secondary coating composition generally ranges from about 15 to about 60 weight percent, and preferably about 20 to about 50 weight percent.

The amount of the secondary coating composition applied to the substrate can vary based upon such factors as the type of substrate and intended use of the substrate, i.e., the environment in which the substrate is to be placed and the nature of the contacting materials.

During application of the secondary coating composition to the substrate, ambient relative humidity generally can range from about 30 to about 80 percent, preferably about 50 percent to 70 percent.

A substantially uncured secondary coating of the secondary coating composition and primary coating is formed on the surface of the substrate during application of the secondary coating composition to the primary coating. Typically, the coating thickness after curing of the substrate having the multilayered composite coating thereon ranges from about 0.4 to about 2.0 mils (about 10 to about 50 micrometers), and preferably about 0.5 to about 1.6 mils (about 12 to about 40 micrometers). Some migration of coating materials between the coating layers, preferably less than about 20 weight percent, can occur.

As used herein, "substantially uncured secondary coating" means that the secondary coating composition, after application to the surface of the substrate, and primary coating form a secondary coating or film which is substantially uncrosslinked, i.e., is not heated to a temperature sufficient to induce significant crosslinking and there is substantially no chemical reaction between the thermosettable dispersion and the crosslinking material of the primary coating.

After application of the secondary coating composition to the substrate, the secondary coating can be at least partially dried in an additional step (B') by evaporating water and/or solvent from the surface of the film by air drying at ambient (about 25° C.) or an elevated temperature for a period sufficient to dry the film but not significantly crosslink the components of the secondary coating composition and primary coating. The heating is preferably only for a short period of time sufficient to ensure that a clear coating composition can be applied over the secondary coating essentially without dissolving the secondary coating. Suitable drying conditions depend on the components of the secondary coating composition and on the ambient humidity, but generally the drying conditions are similar to those discussed above with respect to the primary coating. Also, multiple secondary coating compositions can be applied to develop the optimum appearance. Usually between coats, the previously applied coat is flashed; that is, exposed to ambient conditions for about 1 to 20 minutes.

A clear coating composition is then applied to at least a portion of the secondary coating without substantially curing the secondary coating to form a substantially uncured composite coating thereon. If the clear coating composition is waterborne or solventborne, then it is applied in a wet-on-wet application. The clear coating composition can be applied to the surface of the secondary coating by any of the coating processes discussed above for applying the primary coating composition.

The clear coating composition can be a waterborne coating, solventborne coating or powder coating, as desired, but is preferably a waterborne coating. Preferably the clear coating composition is a crosslinkable coating comprising at least one thermosettable film-forming material and at least one crosslinking material, although thermoplastic film-forming materials such as polyolefins can be used. Suitable waterborne clearcoats are disclosed in U.S. Pat. No. 5,098,947 (incorporated by reference herein) and are based on water soluble acrylic resins. Useful solvent borne clearcoats are disclosed in U.S. Pat. Nos. 5,196,485 and 5,814,410 (incorporated by reference herein) and include polyepoxides and polyacid curing agents. Suitable powder clearcoats are described in U.S. Pat. No. 5,663,240 (incorporated by reference herein) and include epoxy functional acrylic copolymers and polycarboxylic acid crosslinking agents. The clear coating composition can include crosslinking materials and additional ingredients such as are discussed above but not pigments. Preferably the clear coating composition is chemically different or contains different relative amounts of ingredients from the secondary coating composition, although the clear coating composition can be the same as the secondary coating composition but without the pigments.

The amount of the clear coating composition applied to the substrate can vary based upon such factors as the type of substrate and intended use of the substrate, i.e., the environment in which the substrate is to be placed and the nature of the contacting materials.

During application of the clear coating composition to the substrate, ambient relative humidity generally can range from about 30 to about 80 percent, preferably about 50 percent to 70 percent.

A substantially uncured composite coating of the clear coating composition and secondary coating (which includes the primary coating) is formed on the surface of the substrate during application of the clear coating composition to the secondary coating. Typically, the coating thickness after curing of the multilayered composite coating on the substrate ranges from about 0.5 to about 4 mils (about 15 to about 100 micrometers), and preferably about 1.2 to about 3 mils (about 30 to about 75 micrometers).

As used herein, "substantially uncured composite coating" means that the clear coating composition, after application to the surface of the substrate, and secondary coating form a composite coating or film which is substantially uncrosslinked, i.e., is not heated to a temperature sufficient to induce significant crosslinking and there is substantially no chemical reaction between the thermosettable dispersion and the crosslinking material.

After application of the clear coating composition to the substrate, the composite coating can be at least partially dried in an additional step (C') by evaporating water and/or solvent from the surface of the film by air drying at ambient (about 25° C.) or an elevated temperature for a period sufficient to dry the film. Preferably, the clear coating composition is dried at a temperature and time sufficient to crosslink the crosslinkable components of the composite coating. Suitable drying conditions depend on the components of the clear coating composition and on the ambient humidity, but generally the drying conditions are similar to those discussed above with respect to the primary coating. Also, multiple clear coating compositions can be applied to develop the optimum appearance. Usually between coats, the previously applied coat is flashed; that is, exposed to ambient conditions for about 1 to 20 minutes.

After application of the clear coating composition, the composite coating coated substrate is heated to cure the coating films or layers. In the curing operation, water and/or solvents are evaporated from the surface of the composite coating and the film-forming materials of the coating films are crosslinked. The heating or curing operation is usually carried out at a temperature in the range of from about 160° F. to about 350° F. (about 71° C. to about 177° C.) but if needed, lower or higher temperatures can be used as necessary to activate crosslinking mechanisms. The thickness of the dried and crosslinked composite coating is generally about 0.2 to 5 mils (5 to 125 micrometers), and preferably about 0.4 to 3 mils (10 to 75 micrometers).

The invention will further be described by reference to the following examples. The following examples are merely illustrative of the invention and are not intended to be limiting. Unless otherwise indicated, all parts are by weight.

Examples 1–7 illustrate the preparation of dispersions of microparticles containing hydrophobic polymers and reaction products (a) and primary coating compositions made therefrom.

EXAMPLE 1

Polyester Pre-polymer

The polyester was prepared in a four neck round bottom flask equipped with a thermometer, mechanical stirrer, condenser, dry nitrogen sparge, and a heating mantle. The following ingredients were used:

| | |
|---|---|
| 144.0 g | trimethylolpropane |
| 1512.0 g | neopentyl glycol |
| 864.0 g | adipic acid |
| 1080.0 g | isophthalic acid |
| 3.6 g | dibutylin oxide |
| 189.5 g | hydroxyethylethyleneurea |
| 380.0 g | butyl acrylate |
| 380.0 g | methyl methacrylate |
| 4.1 g | lonol (butylated hydroxytoluene) |

The first five ingredients were stirred in the flask at 200° C. until 450 ml of distillate was collected and the acid value dropped to 1.3. The material was cooled to 92° C. and the hydroxyethylethyleneurea was stirred in. The material was reheated and kept at 200° C. for 80 minutes. The mixture was cooled to 58° C. and the final three ingredients were added. The final product was a pale yellow liquid with a Gardner-Holdt viscosity of X, a hydroxyl value of 108, an acid value of 1.7, a number average molecular weight ($M_n$) of 1290, a weight average molecular weight ($M_w$) of 2420, and a non-volatile content of 79.3% (measured at 110° C. for one hour).

EXAMPLE 2

Polyurethane Pre-polymer

The polyurethane was prepared in a four neck round bottom flask equipped with a thermometer, mechanical stirrer, condenser, dry nitrogen atmosphere, and a heating mantle. The following ingredients were used:

| | |
|---|---|
| 247.0 g | diethylene glycol |
| 1616.9 g | caprolactone |
| 18.7 g | dimethylolpropionic acid |
| 0.19 g | butyl stannoic acid |
| 1.9 g | triphenyl phosphite |
| 263.5 g | isophorone diisocyanate |
| 663.3 g | styrene |
| 265.0 g | butyl acrylate |
| 265.0 g | methyl methacrylate |
| 74.1 g | ethylene glycol dimethacrylate |
| 222.2 g | hydroxypropyl methacrylate |
| 74.1 g | acrylic acid |

The first five ingredients were stirred in the flask at 145° C. for 3.5 hours. The material was cooled to 80° C. and the isophorone diisocyanate was added over a 30 minute period. The material was kept at 90° C. for two hours. The mixture was cooled to 60° C. and the final five ingredients were added. The final product was a colorless liquid with a Gardner-Holdt viscosity of D-E.

EXAMPLE 3

Polyester/acrylic Latex

A pre-emulsion was prepared by stirring together the following ingredients:

| | |
|---|---|
| 1516.0 g | water |
| 49.7 g | RHODAPEX CO-436 anionic surfactant which is commercially available from Rhone-Poulenc, Inc.) |

-continued

| | |
|---|---|
| 16.0 g | IGEPAL CO-897 ethoxylated nonylphenol (89% ethylene oxide) which is commercially available from GAF Corp. |
| 3.0 g | dimethylethanolamine |
| 1074.0 g | polyester of Example 1 |
| 90.0 g | hydroxypropyl methacrylate |
| 30.0 g | ethylene glycol dimethacrylate |
| 30.0 g | acrylic acid |
| 269.0 g | styrene |

The pre-emulsion was passed once through a MICROFLUIDIZER® M110T at 8000 psi and transferred to a four neck round bottom flask equipped with an overhead stirrer, condenser, thermometer, and a nitrogen atmosphere. 218.0 g of water used to rinse the MICROFLUIDIZER® was added to the flask. The polymerization was initiated by adding 3.0 g of isoascorbic acid and 0.03 g of ferrous ammonium sulfate dissolved in 47.5 g water followed by a one hour addition of 3.0 g of 70% t-butyl hydroperoxide dissolved in 149.2 g of water. The temperature of the reaction increased from 24° C. to 49° C. The temperature was reduced to 28° C. and 52.2 g of 33.3% aqueous dimethylethanolamine was added followed by 3.0 g of PROXEL GXL (Biocide available from ICI Americas, Inc.) in 10.5 g of water. The final pH of the latex was 6.9, the nonvolatile content was 42.0%, the Brookfield viscosity was 14 cps (spindle #1, 50 rpm), and the particle size was 190 nm.

EXAMPLE 4

Polyurethane/Acrylic Latex

A pre-emulsion was prepared by stirring together the following ingredients:

| | |
|---|---|
| 1000.0 g | water |
| 33.1 g | Rhodapex CO-436 |
| 10.7 g | Igepal CO-897 |
| 1.6 g | dimethylethanolamine |
| 1000.0 g | polyurethane of Example 2 |

The pre-emulsion was passed once through a MICROFLUIDIZER® M110T at 8000 psi and transferred to a four neck round bottom flask equipped with an overhead stirrer, condenser, thermometer, and a nitrogen atmosphere. 150.0 g of water used to rinse the MICROFLUIDIZER® was added to the flask. The polymerization was initiated by adding 2.0 g of isoascorbic acid and 0.02 g of ferrous ammonium sulfate dissolved in 37.0 g water followed by a one hour addition of 2.0 g of 70% t-butyl hydroperoxide dissolved in 100.0 g of water. The temperature of the reaction increased from 28° C. to 52° C. The temperature was reduced to 26° C. and 60.8 g of 33.3% aqueous dimethylethanolamine was added followed by 2.0 g of PROXEL GXL in 7.0 g of water. The final pH of the latex was 7.8, the nonvolatile content was 42.6%, the Brookfield viscosity was 36 cps (spindle #1, 50 rpm).

EXAMPLE 5

Pigment Paste with Acrylic Dispersing Vehicle

A white pigment paste was prepared from the following ingredients:

| | | |
|---|---|---|
| 1538.5 | g | acrylic dispersion (26.0% aqueous dispersion of 35% butyl acrylate, 30% styrene, 18% butyl methacrylate, 8.5% hydroxyethyl acrylate, and 8.5% acrylic acid; 26.0% in water) |
| 400.0 | g | POLYMEG 1000 polytetramethylene ether glycol which is commercially available from DuPont |
| 124.0 | g | monomethyl ether of propylene glycol |
| 940.0 | g | deionized water |
| 40.0 | g | 50% aqueous dimethylethanolamine |
| 32.0 | g | FOAMASTER TCX defoamer which is commercially available from Henkel, Inc. |
| 996.8 | g | R-900 titanium dioxide which is commercially available from DuPont |
| 2936.0 | g | BLANC FIXE barytes which is commercially available from Sachtleben Chemie GmBH |
| 3.2 | g | RAVEN 410 carbon black which is commercially available from Columbian Chemicals Co. |
| 64.0 | g | AEROSIL R972 silica which is commercially available from DeGussa Corp. |

The first six ingredients were stirred together in the given order. The pigments were added in small portions while stirring until a smooth paste was formed. The paste was then recirculated for twenty minutes through an Eiger Minimill with 2 mm zircoa beads. The final product had a Hegman rating of 7.5+.

EXAMPLE 6

Pigment Paste with Polyurethane Dispersing Vehicle

A white pigment paste was prepared from the following ingredients:

| | | |
|---|---|---|
| 1118.0 | g | RESYDROL AX 906W polyurethane dispersion which is commercially available from Vianova Resins (Hoechst-Celanse) |
| 17.2 | g | dimethylethanolamine |
| 86.0 | g | ADDITOL VXW-4926 tall oil glyceride which is commercially available from Vianova Resins (Hoechst-Celanese) |
| 172.0 | g | monobutyl ether of ethylene glycol |
| 567.6 | g | deionized water |
| 3.44 | g | PRINTEX G carbon black which is commercially available from DeGussa Corp. |
| 43.0 | g | AEROSIL R972 silica |
| 258.0 | g | ITEXTRA MICRO-TALC talc which is commercially available from Norwegian Talc, U.K. |
| 989.0 | g | BLANC FIXE barytes |
| 774.0 | g | R-900 titanium dioxide |

The first five ingredients were stirred together in the given order. The pigments were added in small portions while stirring until a smooth paste was formed. The paste was then recirculated for thirty minutes through an Eiger Minimill with 2 mm zircoa beads. The final product had a Hegman rating of 7.5+.

EXAMPLE 7

Primary Coating Composition with Polyester/ Acrylic Latex

A primary coating composition was made by mixing in order the following ingredients:

| | | |
|---|---|---|
| 343.7 | g | pigment paste of Example 5 |
| 30.0 | g | CYMEL ® 325 melamine formaldehyde resin which is commercially available from Cytec Industries, Inc. |
| 6.2 | g | ethylene glycol monohexyl ether |
| 7.1 | g | ISOPAR K ® aliphatic hydrocarbon solvent which is commercially available form Exxon, Inc. |
| 319.1 | g | latex of Example 3 |
| 4.0 | g | 50% aqueous dimethylethanolamine |
| 3.85 | g | COLLACRAL PU 75 aqueous rheology modifier which is commercially available from BASF |
| 135.0 | g | water |

The pH of the coating was 8.4 and the % non-volatile content was 45.3%. The viscosity was 30 seconds as measured on a #4 Ford cup.

The primary coating composition of this example (Sample A) was evaluated against a waterborne polyurethane-based primer/surfacer (commercially available from PPG Industries Lacke GmbH as 70609) (Comparative Sample) which did not contain a microparticle dispersion as in the present invention and which had a non-volatile content of 44.7%. The test substrates were ACT cold roll steel panels 10.16 cm by 30.48 cm (4 inch by 12 inch) electrocoated with a cationically electrodepositable primer commercially available from PPG Industries, Inc. as ED-5000. Both the primary coating composition of the present invention and the commercial primer/surfacer were spray applied (2 coats automated spray with 30 seconds ambient flash between coats) at 60% relative humidity and 21° C. to give a dry film thickness of 25 to 28 micrometers. The panels were baked for 10 minutes at 80° C. and 30 minutes at 165° C. The panels were then topcoated with a red monocoat (commercially available from PPG Industries Lacke GmbH as KH Decklack Magmarot) and baked for 30 minutes at 140° C. to give a film thickness of 40 to 42 micrometers.

The appearance and physical properties of the coated panels were measured using the following tests: Specular gloss was measured at 20° and 60° with a Novo Gloss Statistical Glossmeter from Gardco where higher numbers indicate better performance. Distinction of Image (DOI) was measured using Hunter Lab's Dorigon II where higher numbers indicate better performance. Chip resistance was measured by the Erichsen chip method (STM-0802, 2×2000 g, 30 psi) with a rating of 10 being best. The Koenig hardness of films was measured with a Byk-Gardner Pendulum Tester, where higher numbers indicate greater hardness. Water resistance was measured by immersing panels for 10 days in water at 32° C. followed by rating the amount of film damaged after applying and removing adhesive tape over a crosshatched section of the film (a rating of 0 meaning complete removal of the film and a rating of 10 meaning no loss of film) according to ASTM Test Method D 3359. The following Table 1 provides the measured properties:

TABLE 1

| | Sample A | Comparative Sample |
|---|---|---|
| Gloss of primer/surface at 20° | 58 | 42 |
| DOI of primer/surfacer | 57 | 36 |
| Gloss of topcoat at 20° | 87 | 87 |
| DOI of topcoat | 89 | 89 |
| Chip rating | 8+ | 8+ |
| Water immersion rating | 10 | 10 |

As shown in Table 1, the primary coated substrate of the present invention (Sample A) exhibited better gloss of primer/surfacer at 20° and DOI than the comparative commercially available primer surfacer (Comparative Sample).

EXAMPLE 8

WOWOW Primer with Polyurethane/Acrylic Latex

A primer coating was made by mixing in order the following ingredients:

| | |
|---|---|
| 269.2 g | pigment paste of Example 5 |
| 30.0 g | CYMEL ® 325 melamine formaldehyde resin |
| 6.6 g | ethylene glycol monohexyl ether |
| 7.6 g | ISOPAR K ® aliphatic hydrocarbon solvent |
| 303.8 g | latex of Example 4 |
| 3.0 g | 50% aqueous dimethylethanolamine |
| 8.0 g | COLLACRAL PU 75 aqueous rheology modifier |
| 140.0 g | water |

The pH of the coating was 8.2 and the % non-volatile content was 46.9%. The viscosity was 30 seconds as measured on a #4 Ford cup.

The primary coating composition of this example was tested in both a conventional system in which the primary coating composition was fully baked prior to the application of the topcoats and in a wet-on-wet-on-wet (WOWOW) system in which the topcoats were applied and partially dehydrated, or flashed, by holding them for a short period of time at temperatures too low to induce curing. The primary coating composition of this example was spray applied (2 coats automated spray with 30 seconds ambient flash between coats) at 60% relative humidity and 21° C. One panel was fully cured by flashing it for 10 minutes at 80° C. and baking for 30 minutes at 165° C. (Sample B). A second panel was partially dehydrated by flashing it at 60° C. for one minute prior to application of the topcoats (Sample C). A third panel was kept at ambient temperature (about 25° C.) for three minutes prior to applying the topcoats (Sample D). The thickness of the primary coating composition was 11 to 12 microns. The panels were then coated with a silver metallic waterborne basecoat known as HWBH 5033 (commercially available from PPG Industries). The panels were flash baked for 10 minutes at 80° C. and then coated with an acrylic/melamine clearcoat known as PPG 74666 (commercially available from PPG Industries) and baked for 30 minutes at 140° C. The dry film thickness of the basecoat was 15 microns and the dry film thickness of the clearcoat was 42 microns.

The smoothness of the clearcoats was measured using a Byk Wavescan in which results are reported as long wave and short wave numbers where lower values mean smoother films. The ratio of face and angular reflectance (flop) of the topcoat was measured on an Alcope LMR-200 multiple angle reflectometer where higher numbers show a greater face/flop difference. Gloss, DOI and chip resistance were measured as described in Example 7. The following Table 2 provides the measured properties:

TABLE 2

| | Sample B fully baked | Sample C 1 min at 60° C. | Sample D 3 min at ambient |
|---|---|---|---|
| Gloss of topcoat at 20° | 105 | 105 | 104 |
| Long wave | 5.5 | 5.7 | 5.7 |
| Short wave | 20.1 | 26 | 34 |

TABLE 2-continued

| | Sample B fully baked | Sample C 1 min at 60° C. | Sample D 3 min at ambient |
|---|---|---|---|
| DOI of topcoat | 79 | 83 | 81 |
| Face/flop | 1.54 | 1.62 | 1.51 |
| Chip resistance | — | 9 | 8 |

As shown in Table 2, each of Samples C and D applied by a wet-on-wet-on-wet method without curing the primary coating composition prior to application of the topcoats exhibited good chip resistance, as well as similar gloss of topcoat at 20°, long wave, DOI of topcoat and face/flop when compared to Sample B, in which the primary coating composition was cured and crosslinked prior to application of the topcoats.

EXAMPLE 9

WOWOW Primer with Blocked Isocyanate Crosslinker

A primer coating was made by mixing in order the following ingredients:

| | |
|---|---|
| 468.4 g | pigment paste of Example 6 |
| 144.0 g | BAYHYDUR LS 2186 isocyanurate of hexamethylene diisocyanate blocked with methyl ethyl ketoxime which is commercially available from Bayer Corp. |
| 0.8 g | Borchigol FT848 aqueous rheology modifier which is commercially available from Bayer Corp.) |
| 175.0 g | latex of Example 3 |
| 0.5 g | 50% aqueous dimethylethanolamine |
| 210.0 g | water |

The pH of the coating was 8.2 and the % non-volatile content was 47.0%. The viscosity was 29 seconds as measured on a #4 Ford cup.

The primary coating composition of this example was tested in both a conventional system in which the primary coating composition was fully baked prior to the application of the topcoats and in a wet-on-wet-on-wet (WOWOW) system in which the topcoats were applied without baking the primary coating composition. The primary coating composition of this example was evaluated against a fully baked waterborne polyurethane-based primer/surfacer (commercially available from PPG Industries Lacke GmbH as 70609) (Comparative Sample). The primary coating composition of this example was spray applied (2 coats automated spray with 30 seconds ambient flash between coats) at 60% relative humidity and 21° C. One panel was fully cured by flashing it for 10 minutes at 80° C. and baking for 30 minutes at 165° C. (Sample E). A second panel was partially dehydrated by flashing it at 80° C. for ten minutes prior to application of the topcoats (Sample F). A third panel was kept at ambient temperature for ten minutes prior to applying the topcoats (Sample G). The thickness of the primer was 25 microns for Sample E and 12 microns for Samples F and G, respectively. The panels were then coated with a silver metallic waterborne basecoat known as HWB-5033 (commercially available from PPG Industries). The panels were flash baked for 10 minutes at 80° C. and then coated with an acid/epoxy clearcoat known as HDCT-3601 (commercially available from PPG Industries, Inc.) and baked for 30 minutes at 140° C. The dry film thickness of the basecoat was 15 microns and the dry film thickness of the clearcoat was 42 to 45 microns. Chip resistance was measured by the Erichsen method. The following Table 3 provides the measured properties:

TABLE 3

| | Sample E fully baked | Sample F 10 min at 80 C. | Sample G 10 min ambient | Comparative Sample fully baked |
|---|---|---|---|---|
| Gloss of primer at 20° | 47 | | | 75 |
| Gloss of topcoat at 20° | 92 | 92 | 93 | 93 |
| DOI of topcoat | 73 | 70 | 72 | 72 |
| Chip resistance | 9 | 8 | 8 | 9 |

As shown in Table 3, the values for gloss of topcoat at 20°, DOI of topcoat and chip resistance of Samples F and G prepared according to the present invention were similar to those of Sample E and the Comparative Sample, which were baked to crosslink the primers.

EXAMPLE 10

WOWOW Primer with Polyester/Acrylic Latex

A primer coating was made by mixing in order the following ingredients:

| | |
|---|---|
| 1605.7 g | pigment paste similar to Example 5 but containing 965.2 g titanium dioxide as sole pigment. |
| 393.7 g | pigment paste similar to Example 5 but containing 24.8 g carbon black as sole pigment |
| 165.4 g | CYMEL ® 325 melamine formaldehyde resin |
| 36.4 g | ethylene glycol monohexyl ether |
| 41.7 g | ISOPAR K ® aliphatic hydrocarbon solvent |
| 1805.2 g | latex of Example 3 |
| 18.8 g | 50% aqueous dimethylethanolamine |

The pH of the coating was 8.5 and the % non-volatile content was 51.5%. The viscosity was 29.4 seconds as measured on a #4 Ford cup.

The primary coating composition of this example was tested in both a conventional system in which the primary coating composition was fully baked prior to the application of the topcoats and in a wet-on-wet-on-wet (WOWOW) system in which the topcoats were applied and partially dehydrated, or flashed, by holding them for a short period of time at temperatures too low to induce curing. The primer coating of this example was evaluated against a waterborne polyurethane-based primer (commercially available from PPG Industries Lacke GmbH as 70609) (Comparative Sample) having a non-volatile content of 44.7%. The test substrates were ACT cold roll steel panels (4"×12") electrocoated with a cationically electrodepositable primer commercially available from PPG Industries, Inc. as ED-5000. Each primary coating composition was spray applied (2 coats automated spray with 30 seconds ambient flash between coats) at 70% relative humidity and 21° C. One panel of each primer was fully cured by flashing it for ten minutes at ambient temperature and 10 minutes at 80° C. and baking for 30 minutes at 165° C. (Sample H). Panels used for the WOWOW application were flashed at the temperatures and times shown in the table below (Samples I-K, respectively). The thickness of the primary coating composition was 18 to 23 microns after curing. The panels were then coated with a green metallic waterborne basecoat known as HWB Fidji Vert W820A315 (commercially available from PPG Industries). The panels were flashed for flash baked for 10 minutes at 80° C. and then coated with an acrylic/melamine clearcoat known as PPG 74666 (commercially available from PPG Industries) and baked for 30 minutes at ° C. The dry film thickness of the basecoat was 14 microns and the dry film thickness of the clearcoat was 41 microns.

Water release from the applied films was determined by measuring the nonvolatile percentage (% NV) of the film one minute after application and immediately after the flash. The % NV was determined by applying the coating to a tared strip of aluminum foil and weighing it before and after baking one hour at 110° C. The gloss and DOI of the clearcoats were measured using an Autospect QMS-BP (higher numbers are better). The smoothness of the clearcoats was measured using a Byk Wavescan in which results are reported as long wave and short wave numbers where lower values mean smoother films. The following Tables 4–7 provide the measured properties obtained with the given flash conditions:

TABLE 4

5 minutes at ambient temperature:

| | % NV, 1 min. | % NV, post flash | Gloss | DOI | Long wave | Short wave |
|---|---|---|---|---|---|---|
| Sample H | 59.0 | 64.3 | 63.2 | 67.9 | 8.0 | 30.1 |
| Comparative Sample | 51.4 | 55.0 | Not measurable due to severe cracking | | | |

TABLE 5

2 minutes at ambient temperature, 1 minute at 50° C., 3 minutes at ambient:

| | % NV, 1 min. | % NV, post flash | Gloss | DOI | Long wave | Short wave |
|---|---|---|---|---|---|---|
| Sample I | 61 | 88.8 | 69.3 | 73.2 | 6.8 | 21.61 |
| Comparative Sample | 51.9 | 77.2 | Not measurable due to severe cracking | | | |

TABLE 6

2 minutes at ambient temperature, 10 minutes at 80° C., 3 minutes at ambient:

| | % NV, 1 min. | % NV, post flash | Gloss | DOI | Long wave | Short wave |
|---|---|---|---|---|---|---|
| Sample J | 60.8 | 96.5 | 65.1 | 69.9 | 14.3 | 19.5 |
| Comparative Sample | 52.1 | 97.1 | Not measurable due to severe cracking | | | |

TABLE 7

10 minutes at ambient temperature, 10 minutes at 80° C., 30 minutes at 165° C. (full bake):

| | % NV, 1 min. | % NV, post flash | Gloss | DOI | Long wave | Short wave |
|---|---|---|---|---|---|---|
| Sample K | | | 71 | 74.9 | 7.4 | 13.1 |
| Comparative Sample | | | 66.2 | 71.3 | 10.9 | 15.4 |

As shown in Tables 4–7, primary coating Samples I-K prepared according to the present invention release volatile materials at a substantially higher rate than the primer coating of the Comparative Samples, which permits the primary coatings of the present invention to be coated wet-on-wet with subsequent basecoats. Also as shown above, the primer coating of the Comparative Samples did not release sufficient volatiles to permit it to be coated with a basecoat in a wet-on-wet application.

The methods of the present invention are advantageous in that they provide substrates having composite coatings which exhibit good flow, coalescence and flexibility, as well as popping resistance. In addition, the compositions can be applied at high application solids. The methods of the present invention are particularly advantageous because they provide the smoothness and chip resistance of water reducible polyurethanes, but also provide the sagging and popping resistance of a latex based coating. In addition they have the high solids, low solvent content, and quick water release that allow wet-on-wet-on-wet application.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, we claim:

1. A method for forming a composite coating comprising the steps of:

(A) applying an aqueous primary coating composition to at least a portion of a surface of a substrate, the primary coating composition comprising:

(1) at least one thermosettable dispersion comprising polymeric microparticles having functionality adapted to react with a crosslinking material, the microparticles comprising:

(a) at least one acid functional reaction product of ethylenically unsaturated monomers; and (b) at least one hydrophobic polymer having a number average molecular weight of at least about 500 and an acid value of less than about 20; and (2) at least one crosslinking material, to form a substantially uncured primary coating thereon;

(B) applying a secondary coating composition to at least a portion of the primary coating formed in step (A) without substantially curing the primary coating to form a substantially uncured secondary coating thereon; and (C) applying a clear coating composition to at least a portion of the secondary coating formed in step (B) without substantially curing the secondary coating to form a substantially uncured composite coating thereon.

2. The method according to claim 1, wherein the primary coating composition is applied to the surface of the substrate in step (A) by a coating process selected from the group consisting of dip coating, direct roll coating, reverse roll coating, curtain coating, spray coating, brush coating and combinations thereof.

3. The method according to claim 1, wherein the substrate is selected from the group consisting of metallic substrates, thermoplastic substrates, thermoset substrates and combinations thereof.

4. The method according to claim 3, wherein the substrate is a metallic substrate.

5. The method according to claim 1, wherein the amount of the thermosettable dispersion in the primary coating composition ranges from about 30 to about 90 weight percent on a basis of total resin solids of the primary coating composition.

6. The method according to claim 1, wherein the microparticles have a mean diameter ranging from about 0.01 microns to about 10 microns.

7. The method according to claim 1, wherein the reaction product (a) is the reaction product of at least one ethylenically unsaturated carboxylic acid monomer and at least one other ethylenically unsaturated monomer.

8. The method according to claim 7, wherein the ethylenically unsaturated carboxylic acid monomer is selected from the group consisting of acrylic acid, methacrylic acid, acryloxypropionic acid, crotonic acid, fumaric acid, monoalkyl esters of fumaric acid, maleic acid, monoalkyl esters of maleic acid, itaconic acid, monoalkyl esters of itaconic acid and mixtures thereof.

9. The method according to claim 7, wherein the other ethylenically unsaturated monomer is selected from the group consisting of alkyl esters of acrylic and methacrylic acids, vinyl aromatics, acrylamides, acrylonitriles, dialkyl esters of maleic and fumaric acids, vinyl halides, vinyl acetate, vinyl ethers, allyl ethers, allyl alcohols, derivatives thereof and mixtures thereof.

10. The method according to claim 1, wherein the reaction product (a) is formed by free radical polymerization of the ethylenically unsaturated monomers in the presence of the hydrophobic polymer (b).

11. The method according to claim 1, wherein the reaction product (a) comprises internally crosslinked microparticles.

12. The method according to claim 1, wherein the amount of the reaction product (a) ranges from about 20 to about 60 weight percent on a basis of total resin solids weight of the thermosettable dispersion.

13. The method according to claim 1, wherein the hydrophobic polymer is selected from the group consisting of polyesters, alkyds, polyurethanes, polyethers, polyureas, polyamides, polycarbonates and mixtures thereof.

14. The method according to claim 1, wherein the hydrophobic polymer is at least partially grafted to the reaction product (a).

15. The method according to claim 1, wherein the hydrophobic polymer has a number average molecular weight ranging from about 800 to about 3000.

16. The method according to claim 1, wherein the hydrophobic polymer has an acid value of less than about 10.

17. The method according to claim 1, wherein the amount of the hydrophobic polymer ranges from about 40 to about 80 weight percent on a basis of total resin solids weight of the thermosettable dispersion.

18. The method according to claim 1, wherein the crosslinking material is selected from the group consisting of aminoplasts, polyisocyanates, polyacids, polyanhydrides and mixtures thereof.

19. The method according to claim 1, wherein the amount of the crosslinking material in the primary coating composition ranges from about 5 to about 50 weight percent on a basis of total resin solids of the primary coating composition.

20. The method according to claim 1, wherein the solids content of the primary coating composition ranges from about 40 to about 65 weight percent.

21. The method according to claim 1, wherein the substantially uncured primary coating has a thickness ranging from about 10 to about 60 micrometers.

22. The method according to claim 1, further comprising an additional step (A') of at least partially drying, without substantially curing, the primary coating composition to form the substantially uncured primary coating after step (A).

23. The method according to claim 1, wherein the secondary coating composition is applied to the surface of the substrate in step (B) by a coating process selected from the group consisting of dip coating, direct roll coating, reverse roll coating, curtain coating, spray coating, brush coating and combinations thereof.

24. The method according to claim 1, wherein the secondary coating composition is a pigmented basecoat.

25. The method according to claim 1, wherein the secondary coating composition is selected from the group consisting of waterborne coatings, solventborne coatings and powder coatings.

26. The method according to claim 1, wherein the secondary coating composition is a crosslinkable coating comprising at least one film-forming material and at least one crosslinking material.

27. The method according to claim 1, wherein the solids content of the secondary coating composition ranges from about 15 to about 60 weight percent.

28. The method according to claim 1, wherein the substantially uncured secondary coating has a thickness ranging from about 10 to about 60 micrometers.

29. The method according to claim 1, further comprising an initial step of forming an electrodeposited coating upon the surface of the substrate prior to applying the primary coating composition of step (A).

30. The method according to claim 1, further comprising an additional step (B') of at least partially drying, without substantially curing, the secondary coating composition to form the substantially uncured secondary coating after step (B).

31. The method according to claim 1, wherein the clear coating composition is applied to the surface of the substrate in step (C) by a coating process selected from the group consisting of dip coating, direct roll coating, reverse roll coating, curtain coating, spray coating, brush coating and combinations thereof.

32. The method according to claim 1, wherein the clear coating composition is selected from the group consisting of waterborne coatings, solventborne coatings and powder coatings.

33. The method according to claim 1, wherein the clear coating composition is a crosslinkable coating comprising at least one film-forming material and at least one crosslinking material.

34. The method according to claim 1, wherein the solids content of the clear coating composition ranges from about 30 to about 100 weight percent.

35. The method according to claim 1, wherein the substantially uncured composite coating has a thickness ranging from about 30 to about 180 micrometers.

36. The method according to claim 1, further comprising an additional step (C') of at least partially drying, without substantially curing, the clear coating composition to form the substantially uncured composite coating after step (C).

37. The method according to claim 1, further comprising an additional step (C") of at least substantially curing the composite coating after step (C).

38. A method for forming a composite coating comprising the steps of:

(A) applying an aqueous primary coating composition to at least a portion of a surface of a substrate, the primary coating composition comprising:

(1) at least one thermosettable dispersion comprising polymeric microparticles having functionality adapted to react with a crosslinking material, the microparticles comprising:

(a) at least one acid functional reaction product of acrylic acid, styrene and at least one acrylate or methacrylate; and (b) at least one hydrophobic polymer selected from the group consisting of polyurethanes and polyesters and having a number average molecular weight of about 800 to about 3000 and an acid value of less than about 20; and (2) at least one aminoplast crosslinking material, to form a substantially uncured primary coating thereon;

(B) applying a crosslinkable aqueous basecoat composition to at least a portion of the primary coating formed in step (A) in a wet-on-wet application without substantially curing the primary coating to form a substantially uncured secondary coating thereon; and (C) applying a clear coating composition to at least a portion of the secondary coating formed in step (B) in a wet-on-wet application without substantially curing the secondary coating to form a substantially uncured composite coating thereon.

39. A method for forming a composite coating comprising the steps of:

(A) applying an aqueous primary coating composition to at least a portion of a surface of a substrate, the primary coating composition comprising:

(1) at least one thermosettable dispersion comprising polymeric microparticles having functionality adapted to react with a crosslinking material, the microparticles comprising:

(a) at least one acid functional reaction product of ethylenically unsaturated monomers; and (b) at least one hydrophobic polymer having a number average molecular weight of at least about 500; and (2) at least one crosslinking material, to form a substantially uncured primary coating thereon, the amount of the thermosettable dispersion in the primary coating composition ranging from about 30 to about 90 weight percent on a basis of total resin solids of the primary coating composition;

(B) applying a secondary coating composition to at least a portion of the primary coating formed in step (A) without substantially curing the primary coating to form a substantially uncured secondary coating thereon; and (C) applying a clear coating composition to at least a portion of the secondary coating formed in step (B) without substantially curing the secondary coating to form a substantially uncured composite coating thereon.

40. A method for forming a composite coating comprising the steps of:

(A) applying an aqueous primary coating composition to at least a portion of a surface of a substrate, the primary coating composition comprising:

(1) at least one thermosettable dispersion comprising polymeric microparticles having functionality adapted to react with a crosslinking material, the microparticles comprising:

(a) at least one acid functional reaction product of acrylic acid, styrene and at least one acrylate or methacrylate; and (b) at least one hydrophobic polymer selected from the group consisting of polyurethanes and polyesters and having a number average molecular weight of about 800 to about 3000; and (2) at least one aminoplast crosslinking material, to form a substantially uncured primary coating thereon, the amount of the thermosettable dispersion in the primary coating composition ranging from about 30 to about 90 weight percent on a basis of total resin solids of the primary coating composition;

(B) applying a crosslinkable aqueous basecoat composition to at least a portion of the primary coating formed in step (A) in a wet-on-wet application without substantially curing the primary coating to form a substantially uncured secondary coating thereon; and (C) applying a clear coating composition to at least a portion of the secondary coating formed in step (B) in a wet-on-wet application without substantially curing the secondary coating to form a substantially uncured composite coating thereon.

* * * * *